US005295342A

United States Patent [19]

Roche et al.

[11] Patent Number: 5,295,342

[45] Date of Patent: Mar. 22, 1994

[54] DISPLAY PANEL HAVING DUAL SECUREMENT MEANS

[75] Inventors: Bonnie Roche, 17 W. 54th St., New York, N.Y. 10019; Samuel Farber, New York, N.Y.

[73] Assignee: Bonnie Roche, New York, N.Y.

[21] Appl. No.: 491,661

[22] Filed: Nov. 22, 1989

[51] Int. Cl.[5] ..... E04B 1/61

[52] U.S. Cl. ..... 52/764; 428/14; 428/455; 40/600; 40/621

[58] Field of Search ..... 428/14, 455, 900; 40/600, 621; 52/764, DIG. 4

[56] References Cited

U.S. PATENT DOCUMENTS

| | | | |
|---|---|---|---|
| 2,589,601 | 3/1952 | Burnett | 428/900 X |
| 3,755,053 | 8/1973 | Lindahl | 428/14 X |
| 4,189,857 | 2/1980 | Fujisawa | 428/14 X |
| 4,542,051 | 9/1985 | Cirimele | 428/14 X |
| 4,584,223 | 4/1986 | Krapf | 428/455 X |

FOREIGN PATENT DOCUMENTS

| | | | |
|---|---|---|---|
| 2735308 | 2/1979 | Fed. Rep. of Germany | 52/DIG. 4 |
| 238467 | 9/1987 | United Kingdom | 40/600 |

*Primary Examiner*—Carl D. Friedman
*Assistant Examiner*—Beth A. Aubrey
*Attorney, Agent, or Firm*—Ostrolenk, Faber, Gerb & Soffen

[57] ABSTRACT

A display board, panel, or wall section comprising a penetrating object permeable panel and a ferromagnetic apertured material, preferably a wire mesh, disposed on a surface of the permeable panel, the apertured material being exposed to view and being adapted to receive magnetic means for securing an item to be displayed on the display panel and further having an aperture size such that the permeable panel is adapted to receive a penetrating object, such as a tack, for securing an item to be displayed on the display panel through an aperture of the apertured material.

20 Claims, 3 Drawing Sheets

FIG. 1
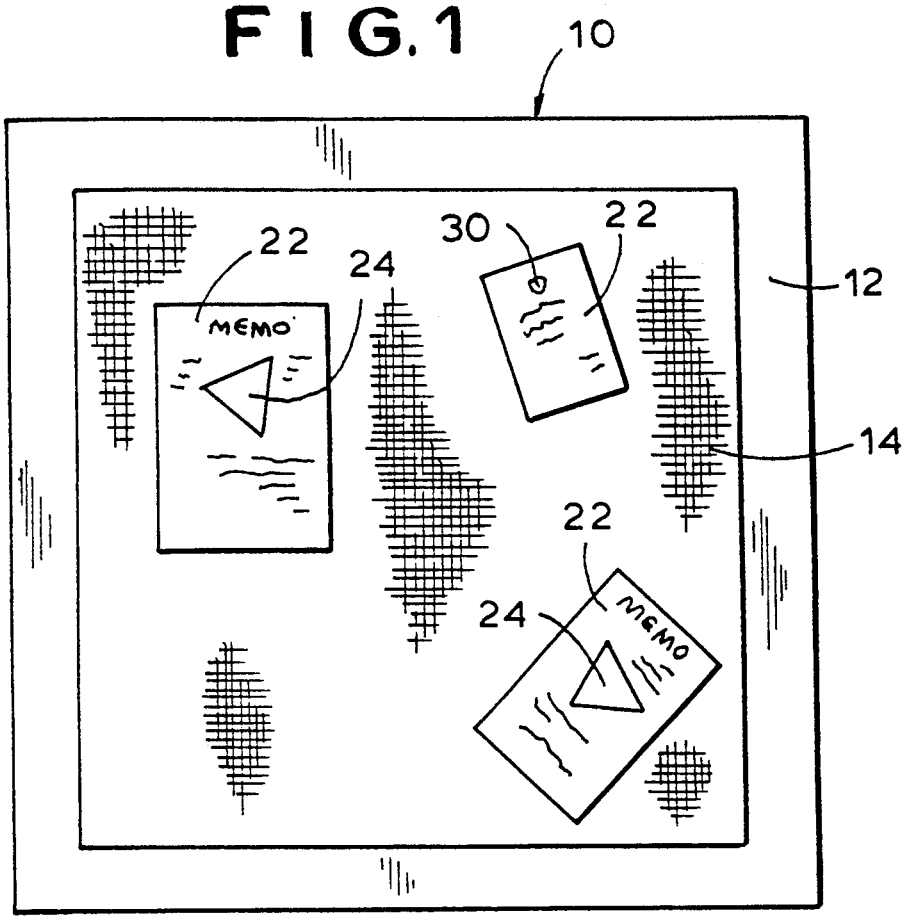
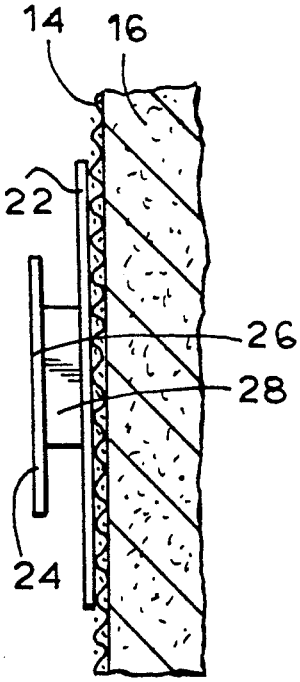
FIG. 3
FIG. 4
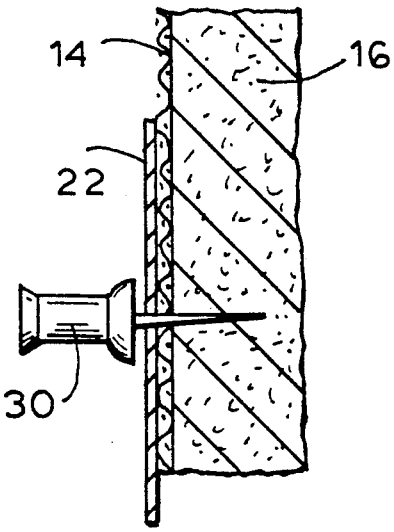
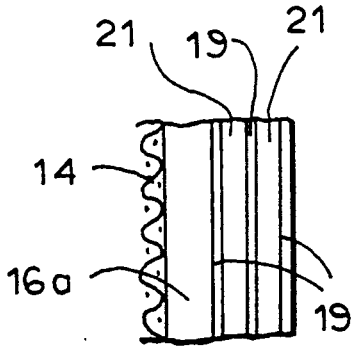
FIG. 6

DISPLAY PANEL HAVING DUAL SECUREMENT MEANS

BACKGROUND OF THE INVENTION

The present invention relates to a display board or panel, e.g., a wall panel attached to a surface or free standing, and in particular, to a display board or panel having multiple means for securing items to be displayed thereon. Even more particularly, the present invention relates to a display board or panel having the capability of securing notes, memos and bulletins, etc., for example, by conventional tacks and pins, by magnetic means, and by tape or other fastening means and which also provides and retains a neat, ornamental, unblemished appearance.

Various types of bulletin or display boards or panels and devices are known. For example, U.S. Pat. No. 4,584,223, to Krapf, discloses a magnetic display panel which is made of a light, generally rigid cardboard or foamed cork core with laminations of non-perforated steel foil arranged thereon, over which paper sheets are secured to cover the outer surfaces of the steel foil.

U.S. Pat. No. 4,146,976, to Zambiasi, discloses a magnetic board for programming and statistical purposes. Each panel of the board consists of a metal sheet, wherein a grating is defined by two pluralities of equidistantly spaced parallel grooves. Magnetic signalling elements can be inserted into the grooves.

U.S. Pat. No. 4,457,723, to Tate, discloses a color changeable fabric wherein hollow strands of the fabric contain a liquid in which color coded micromagnets are dispersed.

U.S. Pat. No. 2,589,601, to Burnett, discloses a magnetic slate wherein erasable symbols may be made by use of a magnet.

U.S. Pat. No. 3,460,276, to Payne, discloses a bistable visual display device having a transparent front panel and a core honeycombed by an array of transversely extending non-intercommunicating duct-like cells partially filled with magnetic powder. To write on the board, it is tilted in an upright position and a magnetic stylus is drawn across its transparent front panel whereupon powder is shifted to the visible front portion of the cells along the path of the stylus.

A type of display board having a tack penetrable surface with limited magnetic capability is also known. In this known bulletin board, a tack permeable core is covered by a vinyl or paper covering between which is sandwiched a ferrous mesh. Glue is applied over the entire permeable core surface enabling the ferrous mesh and vinyl or paper covering to adhere to the base permeable core. The problem and limitation with this design is that the vinyl or paper and glue covering substantially reduces the magnetic attraction of a magnet to the glue covered ferrous mesh thereby minimizing its effectiveness, the resistance of the surface to insertion and application of tacks is increased, and furthermore, the esthetic outer surface appearance of the display board is not retained, the vinyl or paper surface being visibly damaged with each use requiring repeated resurfacing and reglueing to maintain an unsoiled appearance. This type of bulletin board or tack board is shown in Greensteel brochure 10100/GRD.

SUMMARY OF THE INVENTION

It is an object of the present invention to provide a display panel or tack board which has the capability for securing bulletins, memos and other items magnetically, by tacking, pinning, nailing and/or by taping of materials to the display panel.

It is furthermore an object of the present invention to provide a display panel or tack board which has an exposed magnet attractive apertured material or wire mesh screen surface for providing the ability to secure bulletins and memos magnetically and which also provides not only an attractive ornamental appearance, but visibly substantially retains its original undamaged appearance after use over time. The exposed apertured material or wire mesh surface also aids in visually obscuring holes in the underlying tack permeable core material, and if ferrous stainless steel, plated or other magnet attractive non-staining metals are used, serves as a non-staining surface which is essentially maintenance free.

It is yet still a further object of the present invention to provide a display panel which has an attractive ornamental appearance and which can also be used not only as a wall surface-mounted or otherwise supported display panel, but also as a covering for larger wall surfaces, including entire full-height walls, if desired, and as a free-hanging or free-standing display panel which can itself serve as a wall or partition. For example, it is an object of the present invention to provide a modular free standing wall panel which can be used in building office partitions, structures and cubicles, and which at the same time can be used for display purposes e.g., as a bulletin or display board. Accordingly, entire wall structures delineating office spaces can be erected in a modular fashion using the wall panel of the present invention or the wall panel can be surface mounted to already existing walls.

It is yet still another object of the present invention to provide such a display or wall panel which insures increased magnetic securement of notes, bulletins and other items on the display panel, and which magnetic securement is superior to that provided by known boards or panels.

Another object of the present invention is to provide a wall or display panel which provides for increased acoustic absorption properties while at the same time providing a neat, modern, finished, rigid or "hard" appearance.

It is furthermore am object of the present invention to provide a display or wall panel which has a neat, attractive ornamental appearance provided by an exposed metallic apertured material, e.g., a wire mesh or screen.

It is yet still a further object of the present invention to provide such a display or wall panel which, in addition to accepting tacks and magnetic securement, also is adaptable to receiving shelving and other storage units.

The above and other objects of the present invention are achieved by a display or wall panel comprising a penetrating object permeable panel, magnet attractive apertured material being disposed on a surface of the permeable panel, the apertured material being exposed to view and being adapted to receive magnetic means for securing an item to be displayed on the display or wall panel and further having an aperture size such that the permeable panel is adapted to receive a penetrating object for securing an item to be displayed on the display or wall panel through an aperture of the apertured material.

Preferably, the apertured material comprises a ferromagnetic wire mesh and the penetrating object comprises a tack or pin, for example.

Other objects, features and advantages of the present invention will be apparent from the detailed description which follows.

BRIEF DESCRIPTION OF THE DRAWINGS

The invention will be described in greater detail in the following detailed description with reference to the drawings, in which:

FIG. 1 shows a front plan view of a display or wall panel according to the present invention showing several items, e.g., notes or memos, attached thereto by both magnetic and tack or other securement means;

FIG. 3 is a cutaway cross-sectional view showing a note or memo attached to the display or wall panel by a magnetic securement means;

FIG. 4 is a cutaway cross-sectional view showing a note or memo attached to the display or wall panel by a tack;

FIG. 6 shows a cross section through one embodiment of a tack permeable material of the display or wall panel.

DETAILED DESCRIPTION

Figure 2:
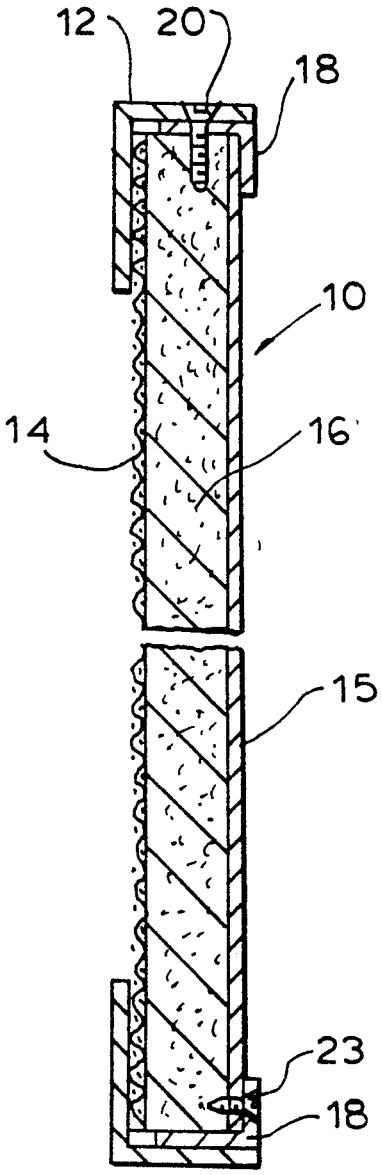
FIG. 2 is a cross-sectional view of the display or wall panel according to the present invention.

With reference now to the drawings, an embodiment of a display or wall panel according to the present invention is designated generally with reference numeral 10. The exemplary display panel comprises a frame 12, illustratively a rectangular frame which can be made of metal, plastic, wood or even a material such as tile or stone. An apertured material, for example, a wire mesh or screen 14 is held in the frame 12 and provides an exposed outer surface. Another suitable material might be a finely apertured sheet metal material. Below the screen 14, a tack permeable material 16 is provided, which can comprise, for example, a fiber board, cork, foam plastic, pressed wood, or pressed paper material, such as MIKOR. A backing layer 15 of paper, e.g. cardboard, or some other material can be provided at the exposed rear of the panel. The material 16 can also comprise a laminate of such materials or a combination of such materials. For example, a cork or pressed wood or paper surface can be provided adjacent to screen 14 and a foam/paper laminate can provide a backing for the cork or pressed wood or paper surface. This is shown, for example, in FIG. 6, where a pressed composition board is shown as the tack permeable material 16*a* laminated to several layers of paper 19 and backed by a foamed plastic 21.

Two angle-shaped sections 18 may be provided adjacent two rear side surfaces of the frame 12. Frame 12 can be secured to the angle-shaped sections 18 and composition board 16 by suitable screws 20, thus holding the entire structure together. Angle-shaped sections 18 may also be secured to board 16 by suitable fasteners 23.

FIG. 3 shows how a note or memo 22 can be secured by a magnetic securement means 24. See also FIG. 1. The magnetic securement means 24 may comprise an ornamental top surface 26 attached to a magnet 28. Screen material 14 is made of a ferrous or other magnetically attractive metal or material, and preferably, a ferrous stainless steel or plated (e.g., chromed) steel for anticorrosion qualities. Wire mesh 14 may also be painted to match the decor of a room, for example, a single color or a plurality of colors, or the screen may be painted with a picture or other artistic or ornamental rendering.

Furthermore, the wire mesh or other apertured material 14 can be contoured such that various moire patterns may be formed on its surface, depending on the user's preference and the incident light.

FIG. 4 shows a penetrating object, such as a tack or pin 30, securing a note or memo to the wire mesh 14. The use of a wire mesh or other magnet attractive apertured material thus allows both magnetic securement and pin securement, in that the wire mesh or apertured material is provided such that a pin will easily pierce the apertures in the wire mesh or apertured material, preferably without distortion of the apertured material or the metal filaments comprising the wire mesh. As discussed, alternatively to a wire mesh, an apertured sheet metal can be used to allow for both magnetic and tack securement. If a wire mesh is used, a rounded wire may be preferable in order to ease or guide a tack or pin into the apertures in the mesh.

Figure 5:
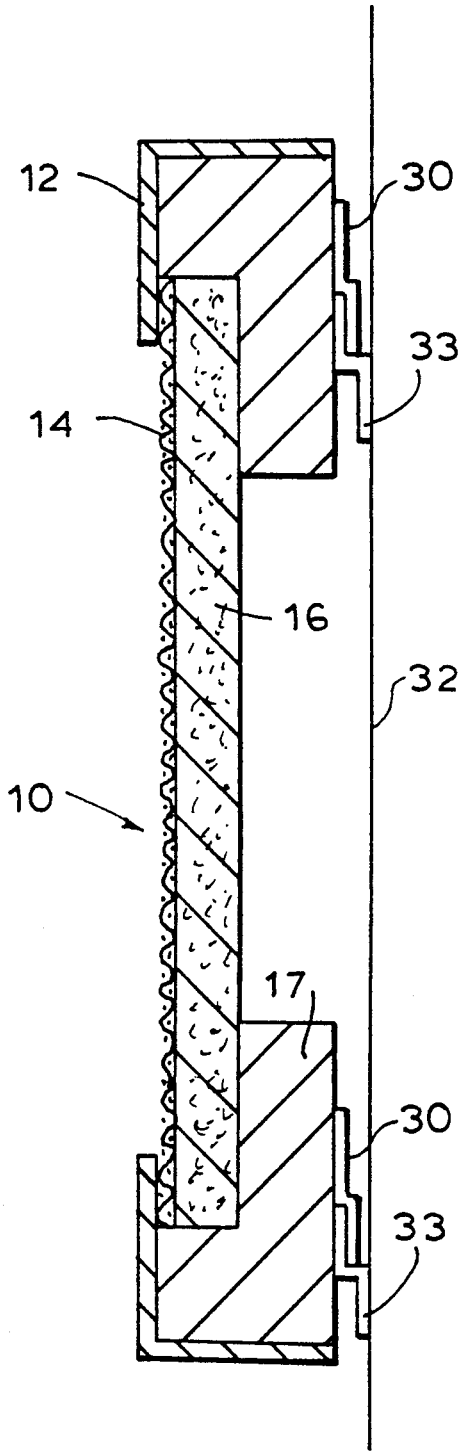
FIG. 5 shows an alternative embodiment of the present invention showing how the display or wall panel according to the present invention may be secured to a wall.

FIG. 5 shows an alternative embodiment of the present invention, which comprises a rectangular frame 12, wire mesh 14 and composition board 16, all secured to a wood or plastic supporting material 17, which is in turn provided with suitable brackets 30, for example, the brackets shown, for securing the display board to a wall 32. In the illustrative embodiment, two pairs of mating Z-shaped brackets 30, 33 are provided, such that the brackets 33 are first secured to the wall 32, and the display panel is then secured to the brackets 33 by sliding brackets 30 into the brackets 33. Of course, other means of attachment to a wall surface could also be provided.

The present invention thus provides a convenient magnetic, pin, nail and/or tape securement display panel or tack board which has a variety of uses.

The display or wall panel according to the present invention can replace conventional cork, composition board, cloth covered board or other decorative wall materials such as FORMICA or other laminates of any of the hanging, surface mounted, or free standing variety and thus also provides the ability to cover, in whole or in part, an existing wall surface or create a new wall. By "free-standing" is meant that the wall panel does not require mounting on an existing wall for support, but instead, may be used to create a wall in itself.

Figure 7:
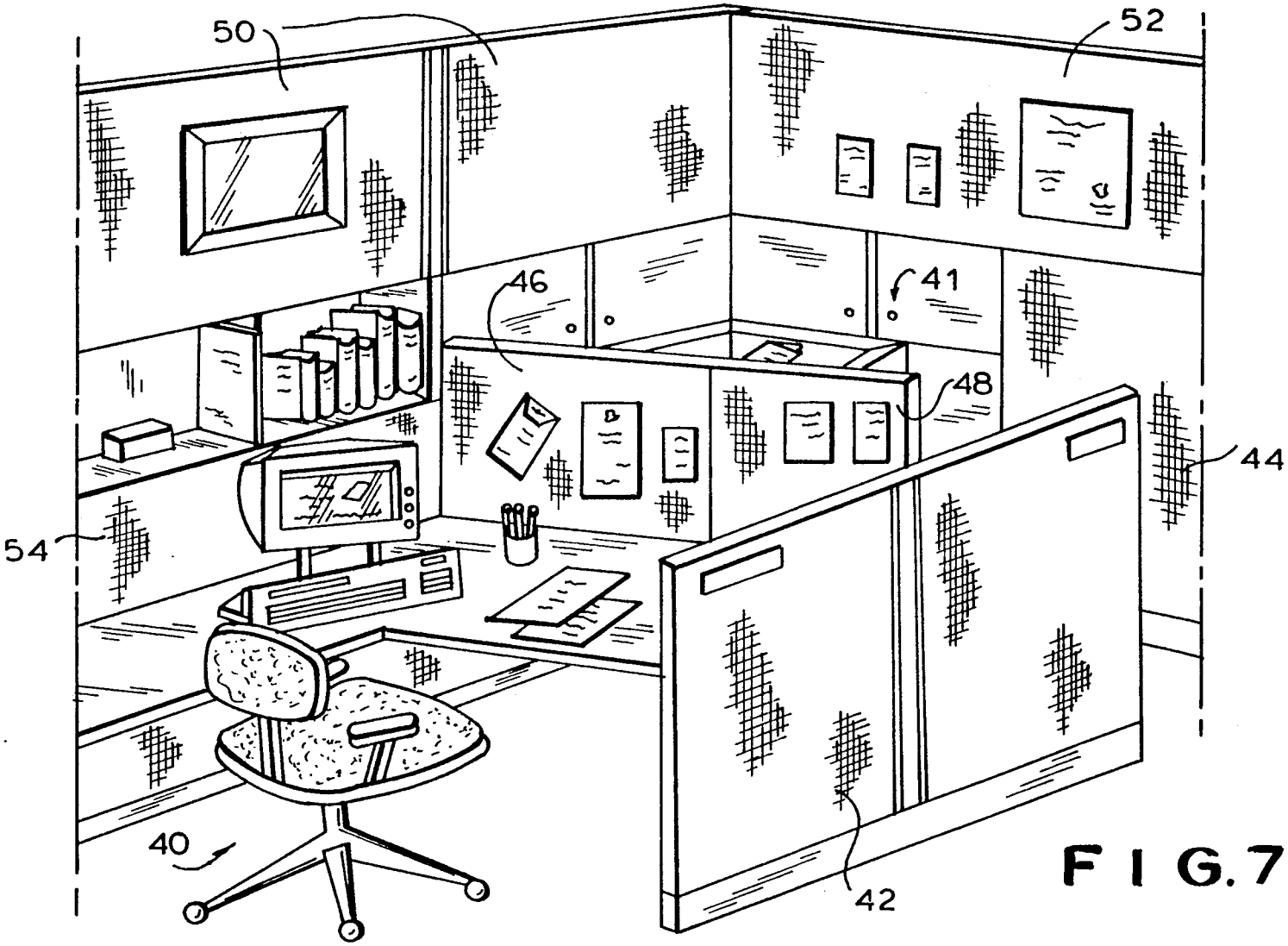
FIG. 7 shows how the display or wall panel of the present invention can be utilized in erecting office partitions or to delineate office areas.

FIG. 7 shows an example of an office area partitioned into individual offices 40 and 41 using the panel material of the present invention. In the case shown in FIG. 7, the wall panel may be free standing as shown at 42, 44, 46, 48, 50, 52 and 54, and need not rely for support on existing walls. Instead, the panels themselves form the walls, and at the same time, convenient display panels for notes, memos, bulletins and other items, as shown. Separate bulletin boards are not necessary. Furthermore, the wall panels provide a convenient base for shelves or other storage units, as shown.

Additionally, the invention could also be used to cover existing walls, providing a neat, attractive appearance and a means for securing items to be displayed on the walls.

The display panel according to the present invention provides a neat, attractive ornamental appearance, does not noticeably show the presence of tack holes because the apertured material or wire mesh is provided over the underlying tack permeable surface, and also allows for the use of various materials as the tack permeable board.

The display or wall panel of the present invention also can be designed to have suitable acoustic or sound absorbing properties, as desired by constructing the panel from suitable acoustic materials.

The apertured material or wire mesh 14 may also be adhesively disposed on the tack permeable material 14, and an intermediate layer of paper, cloth or vinyl, for example, can be disposed between the apertured material or mesh 14 and material 16 for ornamental reasons or such an intermediate layer can be used which is "self healing" to further help hide tack marks. Additionally, for some display panels or boards as shown in FIG. 1, externally visible frame 12 can be dispensed with. Alternatively, a border of a decorative pliable material, such as a vinyl or paper material, can be adhesively fastened to the apertured material or wire mesh 14 and/or board 16. Further, a frame or border can be dispensed with entirely. In the case of large wall panels or wall coverings, it may be preferable to dispense with any border or edge areas, as taste dictates.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A display panel comprising:

a penetrating object permeable panel; and a magnet attractive apertured mesh material disposed on a surface of said permeable panel, said apertured material being exposed to view and being adapted to receive magnetic means for securing an item to be displayed on the display panel and further having an aperture size such that the permeable panel is adapted to receive a penetrating object for securing an item to be displayed on the display panel through an aperture of the apertured material, said apertured material being such that a penetrating object will be directed into an aperture of the apertured material regardless of the position of said penetrating object over the apertured material.

2. The display panel recited in claim 1, wherein said apertured material comprises a ferromagnetic material.

3. The display panel recited in claim 2, wherein said apertured material comprises a ferromagnetic stainless steel.

4. The display panel recited in claim 1, further comprising a frame surrounding said permeable panel and said apertured material.

5. The display panel recited in claim 4, wherein said apertured material is loosely placed on the surface of said permeable panel and said frame holds said apertured material in place on said permeable panel.

6. The display panel recited in claim 4, further comprising a support disposed behind said permeable panel fastened to said frame.

7. The display panel recited in claim 6, wherein said support comprises two angle-shaped brackets disposed along respective rear sides of said frame.

8. The display panel recited in claim 1, wherein said apertured material is painted.

9. The display panel recited in claim 8, wherein said apertured material is painted with an ornamental design.

10. The display panel recited in claim 1, wherein said permeable panel comprises one of a pressed composition panel, cork or plastic.

11. The display panel recited in claim 1, wherein said permeable panel is laminated to a foamed plastic backing material.

12. The display panel recited in claim 11, wherein said foamed plastic backing material is laminated to a paper material providing a rear surface for said display panel.

13. The display panel recited in claim 1, further comprising a mounting device disposed on a rear portion of said display panel for securement of said display panel to a wall.

14. The display panel recited in claim 1, wherein said display panel comprises a surface substantially coextensive with a wall on which the display panel is disposed.

15. The display panel recited in claim 1, wherein said apertured material is adhesively joined to said permeable panel, at least in selected portions thereof.

16. The display panel recited in claim 15, further comprising a border of decorative material surrounding edges of the permeable panel, said border being adhesively joined to said apertured material.

17. The display panel recited in claim 1, wherein said display panel is free standing.

18. The display panel recited in claim 1, wherein the aperture size of the apertured material is such that a penetrating object disposed through an aperture thereof will not substantially distort the apertured material.

19. The display panel recited in claim 1, wherein the apertured material comprises a wire mesh.

20. The display panel recited in claim 19, wherein the aperture size of the wire mesh is such that a penetrating object disposed through an aperture thereof will not substantially distort filaments of the wire mesh.

* * * * *